US011946676B2

(12) United States Patent
Taras et al.

(10) Patent No.: US 11,946,676 B2
(45) Date of Patent: Apr. 2, 2024

(54) FIXED ORIFICE REFRIGERANT DISTRIBUTION SYSTEM

(71) Applicant: Goodman Manufacturing Company, L.P., Waller, TX (US)

(72) Inventors: Michael F. Taras, Spring, TX (US); Gunar Neto, Houston, TX (US); Kazuo Fujisaki, Katy, TX (US)

(73) Assignee: Goodman Manufacturing Company, L.P., Waller, TX (US)

( * ) Notice: Subject to any disclaimer, the term of this patent is extended or adjusted under 35 U.S.C. 154(b) by 42 days.

(21) Appl. No.: 17/711,952

(22) Filed: Apr. 1, 2022

(65) Prior Publication Data

US 2023/0314052 A1 Oct. 5, 2023

(51) Int. Cl.
*F25B 41/37* (2021.01)
*F25B 39/00* (2006.01)

(52) U.S. Cl.
CPC ..... *F25B 41/37* (2021.01); *F25B 39/00* (2013.01); *F25B 2339/02* (2013.01); *F25B 2341/062* (2013.01)

(58) Field of Classification Search
CPC ..... F25B 41/37; F25B 39/00; F25B 39/02; F25B 39/028; F25B 2339/02; F25B 2341/062; F25B 2341/06; F25B 41/30
See application file for complete search history.

(56) References Cited

U.S. PATENT DOCUMENTS

| | | | | |
|---|---|---|---|---|
| 7,878,780 | B2 | 2/2011 | Bush et al. | |
| 10,948,208 | B2 | 3/2021 | Oka et al. | |
| 2010/0107659 | A1 | 5/2010 | Hildreth | |
| 2015/0121950 | A1 | 5/2015 | Chowdhury et al. | |
| 2018/0156512 | A1 | 6/2018 | Mislak | |
| 2019/0226692 | A1 | 7/2019 | Yamada et al. | |
| 2019/0368819 | A1* | 12/2019 | Gupte | F25B 39/00 |
| 2020/0088451 | A1* | 3/2020 | Saito | F28F 9/0273 |

FOREIGN PATENT DOCUMENTS

| | | | |
|---|---|---|---|
| EP | 0362118 | A2 | 4/1990 |
| EP | 2310786 | B1 | 9/2014 |
| EP | 2778595 | B1 | 1/2017 |
| JP | 6-159983 | A | 6/1994 |

* cited by examiner

*Primary Examiner* — Len Tran
*Assistant Examiner* — Kamran Tavakoldavani
(74) *Attorney, Agent, or Firm* — Eubanks PLLC

(57) ABSTRACT

An HVAC system having a fixed orifice expansion device coupled to an evaporator coil is provided. In one embodiment, an expansion device coupled to an evaporator coil includes a flow restrictor and an evaporator inlet manifold. The flow restrictor includes multiple fixed orifices aligned with the refrigerant distribution tubes to restrict flow of refrigerant from the evaporator inlet manifold into the refrigerant distribution tubes through the multiple fixed orifices. Additional systems, devices, and methods are also disclosed.

2 Claims, 10 Drawing Sheets

FIXED ORIFICE REFRIGERANT DISTRIBUTION SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Modern residential and industrial customers expect indoor spaces to be climate controlled. In general, heating, ventilation, and air conditioning ("HVAC") systems circulate an indoor space's air over low-temperature (for cooling) or high-temperature (for heating) sources, thereby adjusting the indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat. Within a typical HVAC system, a fluid refrigerant circulates through a closed loop of tubing that uses a compressor and other flow-control devices to manipulate the refrigerant's flow and pressure, causing the refrigerant to cycle between the liquid and gas phases. Generally, these phase transitions occur within the HVAC's heat exchangers, which are part of the closed loop and designed to transfer heat between the circulating refrigerant and flowing ambient air.

In some instances, a HVAC system is a split system having indoor and outdoor units, each having a heat exchanger, connected in fluid communication. As would be expected in such cases, the heat exchanger providing heating or cooling to the climate-controlled space or structure is described adjectivally as being "indoors," and the heat exchanger transferring heat with the surrounding outdoor environment is described as being "outdoors." The refrigerant circulating between the indoor and outdoor heat exchangers—transitioning between phases along the way—absorbs heat from one location and releases it to the other. Those in the HVAC industry describe this cycle of absorbing and releasing heat as "pumping." To cool the climate-controlled indoor space, heat is "pumped" from the indoor side to the outdoor side. And the indoor space is heated by doing the opposite, pumping heat from the outdoors to the indoors.

In some other instances, a packaged HVAC system is a self-contained unit including two heat exchangers (e.g., an evaporator coil and a condenser coil), a blower, a compressor, and a refrigerant circuit installed in a shared cabinet. A packaged HVAC system can be installed at any suitable location but is often installed outside, such as on the ground or on the roof of a building. Heated or cooled air is provided from the packaged HVAC system to the indoor space of a building, such as through a supply duct, and air is drawn from the indoor space to the packaged HVAC system, such as through a return duct.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Certain embodiments of the present disclosure generally relate to refrigerant expansion devices for HVAC systems. More specifically, some embodiments relate to a fixed orifice expansion device having multiple fixed orifices. In one embodiment, a fixed orifice expansion device includes a manifold and a fixed orifice distributor having multiple fixed orifices in a shared body. The multiple fixed orifices are aligned with refrigerant distribution tubes to an evaporator coil. The fixed orifices restrict flow and create pressure drop of refrigerant flowing from the manifold into the refrigerant distribution tubes through the orifices. Different distributors and orifices may be used with the manifold to provide desired pressure drop for refrigerant flowing to the evaporator coil. The fixed orifice expansion device may be installed in a packaged system, a split system, or any other suitable HVAC system.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
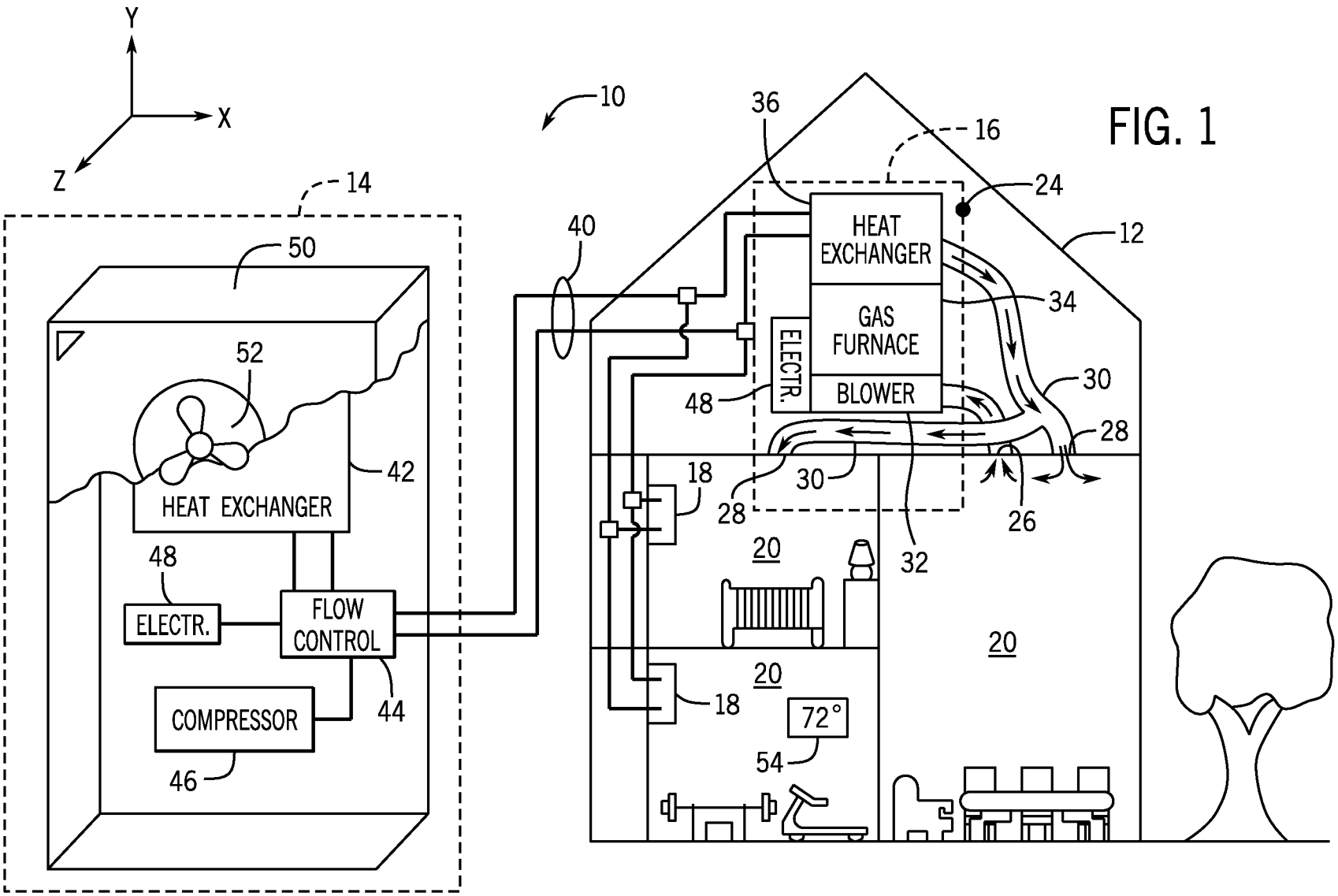
FIG. 1 illustrates schematically an HVAC system for heating and cooling indoor spaces within a structure, in accordance with one embodiment of the present disclosure.

By way of example, and turning now to the figures, FIG. 1 illustrates a split HVAC system 10 in accordance with one embodiment. As depicted, the system 10 provides heating and cooling for a residential structure 12. But the concepts disclosed herein are applicable to a myriad of heating and cooling situations, including industrial and commercial settings. And while some HVAC systems provide each of heating, ventilation, and air conditioning, others do not. The term "HVAC system," as used herein, means a system that provides one or more of heating, ventilation, air conditioning, or refrigeration. For example, an air conditioner that does not provide heating or ventilation is considered an HVAC system. The use of the term "HVAC" in describing a system, unit, component, equipment, etc., herein is not to be interpreted as a requirement that each of heating, ventilation, and air conditioning is provided.

Many North American residences, as well as some commercial and industrial buildings, employ "ducted" systems, in which a structure's ambient air is circulated over a central indoor heat exchanger and then routed back through relatively large ducts (or ductwork) to multiple climate-controlled indoor spaces. However, the use of a central heat exchanger can limit the ducted system's ability to vary the temperature of the multiple indoor spaces to meet different occupants' needs. This is often resolved by increasing the number of separate systems within the structure—with each system having its own outdoor unit that takes up space on the structure's property, which may not be available or at a premium.

Some buildings also or instead employ "ductless" systems, in which refrigerant is circulated between an outdoor unit and one or more indoor units to heat and cool specific indoor spaces. Unlike ducted systems, ductless systems route conditioned air to the indoor space directly from the indoor unit—without ductwork.

The described HVAC system 10 of FIG. 1 is a split system with two primary portions: the outdoor unit 14, which mainly comprises components for transferring heat with the environment outside the structure 12; and the indoor units 16 & 18, which mainly comprise components for transferring heat with the air inside the structure 12. In the illustrated structure, a ducted indoor unit 16 and ductless indoor units 18 provide heating and cooling to various indoor spaces 20.

Focusing on the ducted indoor unit 16, it has an air-handler unit (or AHU) 24 that provides airflow circulation, which in the illustrated embodiment draws ambient indoor air via a return vent 26, passes that air over one or more heating/cooling elements (i.e., sources of heating or cooling), and then routes that conditioned air, whether heated or cooled, back to the various climate-controlled spaces 20 through supply vents 28. As depicted in FIG. 1, air between the AHU 24 (which may also be referred to as an air handler) and the vents 26 and 28 is carried by ducts or ductwork 30, which are relatively large pipes that may be rigid or flexible. A blower 32 provides the motivational force to generate airflow and circulate the ambient air through the vents 26 and 28, AHU 24, and ducts 30.

As shown, the ducted indoor unit 16 is a "dual-fuel" system that has multiple heating elements. A gas furnace 34, which may be located downstream (in terms of airflow) of the blower 32, combusts natural gas to produce heat in furnace tubes (not shown) that coil through the furnace. These furnace tubes act as a heating element for the ambient indoor air being pushed out of the blower 32, over the furnace tubes, and into supply ducts 30 to supply vents 28. In other instances, the furnace 34 is an electric furnace, with one or more heat strips or other electric heating elements for heating air passing through the AHU 24, rather than a gas furnace. Whether gas or electric, the furnace 34 is generally operated when robust heating is desired. During conventional heating and cooling operations, air from the blower 32 is routed over an indoor heat exchanger 36 and into the supply ducts 30.

The blower 32, furnace 34, and indoor heat exchanger 36 may be packaged as an integrated AHU, or those components may be modular. Moreover, it is envisaged that the positions of the furnace, indoor heat exchanger, and blower can be reversed or rearranged. Internal components of the blower 32, the furnace 34, and the indoor heat exchanger 36 can be positioned within one or more casings, cabinets, or other housings (integrated or modular).

The indoor heat exchanger 36—which in this embodiment for the ducted indoor unit 16 is an A-coil 38 (FIG. 2), as it known in the industry—can act as a heating or cooling element that adds or removes heat from the structure by manipulating the pressure and flow of refrigerant circulating within and between the A-coil 38 and the outdoor unit 14 via refrigerant lines 40.

In the illustrated embodiment of FIG. 1, the state of the A-coil 38 (i.e., absorbing or releasing heat) is the opposite of the outdoor heat exchanger 42. More specifically, if heating is desired, the illustrated indoor heat exchanger 36 acts as a condenser, aiding transition of the refrigerant from a high-pressure gas to a high-pressure liquid and releasing heat in the process. And the outdoor heat exchanger 42 acts as an evaporator, aiding transition of the refrigerant from a low-pressure liquid to a low-pressure gas, thereby absorbing heat from the outdoor environment. If cooling is desired, the outdoor unit 14 has flow-control devices 44 that reverse the flow of the refrigerant—such that the outdoor heat exchanger 42 acts as a condenser and the indoor heat exchanger 36 acts as an evaporator. The outdoor unit 14 also contains other equipment—like a compressor 46, which provides the motivation for circulating the refrigerant, and electrical control circuitry 48, which provides command and control signals to various components of the system 10.

The outdoor unit 14 is a side-flow unit that houses, within a plastic or metal casing or housing 50, the various components that manage the refrigerant's flow and pressure. This outdoor unit 14 is described as a side-flow unit because the airflow across the outdoor heat exchanger 42 is motivated by a fan that rotates about an axis that is non-perpendicular with respect to the ground. In contrast, "up-flow" devices generate airflow by rotating a fan about an axis generally perpendicular to the ground. (As illustrated, the Y-axis is perpendicular to the ground.) In one embodiment, the side-flow outdoor unit 14 may have a fan 52 that rotates about an axis that is generally parallel to the ground. (As illustrated, the X- and Z-axes are parallel to the ground.) It is envisaged that either up-flow or side-flow units could be employed. Advantageously, the side-flow outdoor unit 14 provides a smaller footprint than traditional up-flow units, which are more cubic in nature.

In addition to the ducted indoor unit 16, the illustrated HVAC system has ductless indoor units 18 that also circulate refrigerant, via the refrigerant lines 40, between the outdoor heat exchanger 42 and the ductless indoor unit's heat exchanger. The ductless indoor units 18 may work in conjunction with or independent of the ducted indoor unit 16 to heat or cool the given indoor space 20. That is, the given indoor space 20 may be heated or cooled with the structure's air that has been conditioned by the ductless indoor unit 18 and by the air routed through the ductwork 30 after being conditioned by the A-coil 38, or it may be entirely conditioned by the ductless indoor unit or the ducted indoor unit working independent of one another. As another embodiment, the A-coil refrigerant loop may be operated to provide cooling or heating only—and the ductless indoor units may also be designed to provide cooling or heating only.

As is well known, the HVAC system may be in communication with a thermostat 54 that senses the indoor space's temperature and allows the structure occupants to "set" the desired temperature for that sensed indoor space. The thermostat may operate using a simple on/off protocol that sends 24V signals, for example, to the HVAC system to either activate or deactivate various components; or it may be a more complex thermostat that uses a "communicating protocol," such as ClimateTalk or a proprietary protocol, that sends and receives data signals and can provide more complex operating instructions to the HVAC system.

Figure 2:
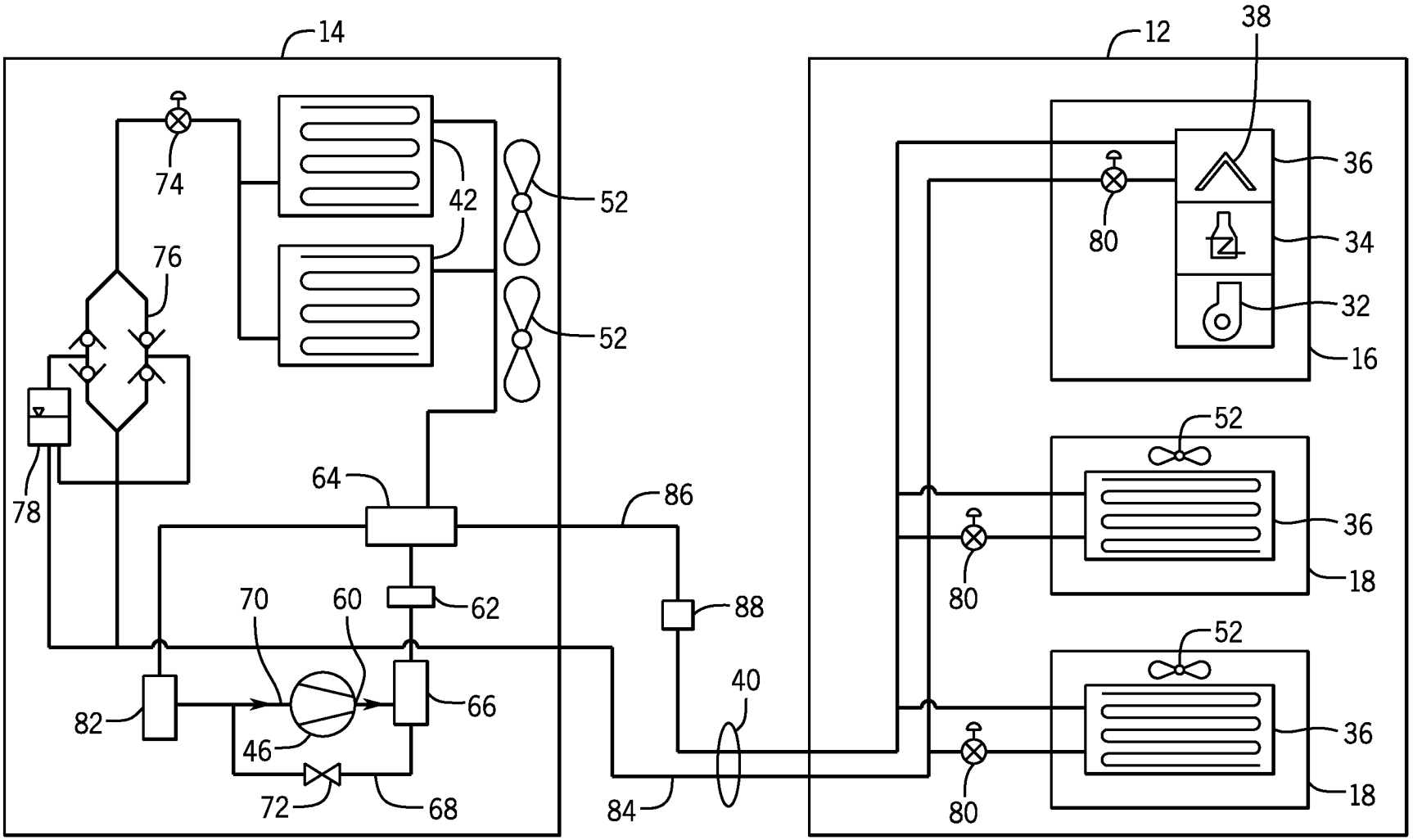
FIG. 2 is a schematic process-and-instrumentation drawing of an HVAC system for heating and cooling indoor spaces within a structure, in accordance with one embodiment.

FIG. 2 provides further detail about the various components of an HVAC system and their operation. The compressor 46 draws in gaseous refrigerant and pressurizes it, sending it into the closed refrigerant loop 40 via compressor outlet 60. (A flow meter 62 may be used to measure the flow of refrigerant out of the compressor.) The outlet 60 is connected to a reversing valve 64, which may be electronic, hydraulic, or pneumatic and which controls the routing of the high-pressure gas to the indoor or outdoor heat exchangers. Moreover, the outlet 60 may be coupled to an oil separator 66 that isolates oil expelled by the compressor and, via a return line 68, returns the separated oil to the compressor inlet 70—to help prevent that expelled oil from reaching the downstream components and helping ensure the compressor maintains sufficient lubrication for operation. The oil return line 68 may include a valve 72 that reduces the pressure of the oil returning to the compressor 46.

To cool the structure, the high-pressure gas is routed to the outdoor heat exchangers 42, where airflow generated by the fans 52 aids the transfer of heat from the refrigerant to the environment—causing the refrigerant to condense into a liquid that is at high-pressure. As shown, the outdoor unit 14 has multiple heat exchangers 42 and fans 52 connected in parallel, to aid the HVAC system's operation.

The refrigerant leaving the heat exchangers 42 is or is almost entirely in the liquid state and flows through or bypasses a metering device 74. From there, the high-pressure liquid refrigerant flows into a series of receiver check valves 76 that manage the flow of refrigerant into the receiver 78. The receiver 78 stores refrigerant for use by the system and provides a location where residual high-pressure gaseous refrigerant can transition into liquid form. The receiver may be located within the casing 50 of the outdoor unit or may be external to the casing 50 of the outdoor unit (or the system may have no receiver at all). From the receiver 78, the high-pressure liquid refrigerant flows to the indoor units 16, 18, specifically to metering devices 80 that restrict the flow of refrigerant into each heat exchanger of the indoor units 16, 18, to reduce the refrigerant's pressure. The refrigerant leaves the indoor metering devices 80 as a low-pressure liquid (or mostly liquid). The metering device 80 may take any suitable form. The metering device 80 may be an electronic expansion valve, for instance, but other types of metering devices—like capillaries, thermal expansion valves, pistons, or reduced orifice tubing—are also envisaged. In at least some embodiments, and as described in greater detail below, the metering device 80 is a fixed orifice expansion device (e.g., expansion device 116 of FIG. 4) for restricting flow of refrigerant to a heat exchanger 36.

Low-pressure liquid refrigerant is then routed to the indoor heat exchangers 36. As illustrated, the indoor heat exchanger 36 for the ducted indoor unit 16 is an "A-coil" style heat exchanger 38. But the heat exchanger 38 can be an "N-coil" (or "Z-coil") style heat exchanger or a slab coil or can take any other suitable form. Airflow generated by the blower 32 aids in the absorption of heat from the flowing air by the refrigerant, causing the refrigerant to transition from a low-pressure liquid to a low-pressure gas as it progresses through the indoor heat exchanger 36. And the airflow generated by the blower 32 drives the now cooled air into the ductwork 30 (specifically the supply ducts), cooling the indoor spaces 20. In a similar fashion, the low-pressure liquid refrigerant is routed to the indoor heat exchangers 36 of the ductless indoor units 18, where it is evaporated, causing the refrigerant to absorb heat from the environment. However, unlike the ducted indoor unit, the ductless indoor units circulate air without ductwork, using a local fan 52, for example.

The refrigerant leaving the indoor heat exchangers 36, which is now entirely or mostly a low-pressure gas, is routed to the reversing valve 64 that directs refrigerant to the accumulator 82. Any remaining liquid in the refrigerant is separated in the accumulator, ensuring that the refrigerant reaching the compressor inlet 70 is almost entirely in a gaseous state. The compressor 46 then repeats the cycle, by compressing the refrigerant and expelling it as a high-pressure gas.

For heating the structure 12, the process is reversed. High-pressure gas is still expelled from the compressor outlet 60 and through the oil separator 66 and flow meter 62. However, for heating, the reversing valve 64 directs the high-pressure gas to the indoor heat exchangers 36. There, the refrigerant—aided by airflow from the blower 32 or the fans 52—transitions from a high-pressure gas to a high-pressure liquid, rejecting heat. And that heat is driven by the airflow from the blower 32 into the ductwork 30 or by the fans 52 in the ductless indoor units 18, heating the indoor spaces 20. If more robust heating is desired, the gas furnace 34 may be ignited, either supplementing or replacing the heat from the heat exchanger. That generated heat is driven into the indoor spaces by the airflow produced by the blower 32. In other instances, electric heating elements (e.g., of an electric furnace 34 of the indoor units 16 or 18) may also or instead be used to provide heat to the indoor spaces 20.

The high-pressure liquid refrigerant leaving each indoor heat exchanger 36 is routed through or past the given metering device 80. Using the refrigerant lines 40, the high-pressure liquid refrigerant is routed to the receiver check valves 76 and into the receiver 78. As described above, the receiver 78 stores liquid refrigerant and allows any refrigerant that may remain in gaseous form to condense. From the receiver, the high-pressure liquid refrigerant is routed to an outdoor metering device 74, which lowers the pressure of the liquid. Like the indoor metering device 80, the illustrated outdoor metering device 74 may take any suitable form. It is envisaged that the outdoor metering device could be any number of devices, including capillaries, electronic expansion valves, thermal expansion valves, pistons, or reduced orifice tubing, for example. In some embodiments, the metering device 74 is a fixed orifice expansion device (e.g., expansion device 116 of FIG. 4) for restricting flow of refrigerant to a heat exchanger 42.

The lower-pressure liquid refrigerant is then routed to the outdoor heat exchangers 42, which are acting as evaporators. That is, the airflow generated by the fans 52 aids the transition of low-pressure liquid refrigerant to a low-pressure gaseous refrigerant, absorbing heat from the outdoor environment in the process. The low-pressure gaseous refrigerant exits the outdoor heat exchanger 42 and is routed to the reversing valve 64, which directs the refrigerant to the accumulator 82. The compressor 46 then draws in gaseous refrigerant from accumulator 82, compresses it, and then expels it via the outlet 60 as high-pressure gas, for the cycle to be repeated.

As illustrated in FIG. 2, the system is a "two-pipe" variable refrigerant flow system, in which the HVAC system's refrigerant is circulated between the outdoor and indoor units via two refrigerant lines 40, one of which is a line that carries predominantly liquid refrigerant (a liquid line 84) and one of which is a line that carries predominately gas refrigerant (a gas line 86). However, it is also envisaged that, in other embodiments, aspects described herein could be applied to a three-pipe variable refrigerant flow system, in which in addition to the gas and liquid lines a third discharge line aids in the circulation of refrigerant.

In many instances, the structure 12 may have had a previous HVAC system with pre-existing refrigerant piping at least partially built into the structure's interior walls. For example, the pre-existing system may be a traditional HVAC unit that uses circulating refrigerant for cooling only and a gas furnace for heating, with all of the conditioned air delivered to the interior spaces via the ductwork. And the pre-existing refrigerant lines—which are built into the walls of the structure—may have a gas line with a ⅝-inch, ⅞-inch, or ⅜-inch outer diameter gas line. However, in certain embodiments, the outdoor unit 14 may have more modern refrigerant piping, which tends to be smaller in outer diameter. For example, the outdoor unit 14 may be 2-, 3-, or 4-Ton unit that has a gas line diameter of ⅝ inch. It would be laborious and cost ineffective to replace the pre-existing gas line in the structure with ⅝-inch diameter tubing. Accordingly, the illustrated HVAC system includes a coupler 88 that helps couple the varying diameter gas lines to one another. For example, the coupler 88 may facilitate coupling of the outdoor unit's ⅝-inch diameter gas line to the structure's pre-existing ⅝-inch, ⅞-inch, or ⅜-inch diameter gas line. In another embodiment, the outdoor unit 14 may be a 5-Ton unit with a gas line having a diameter of ⅝ inch. The coupler could facilitate coupling of this outdoor unit with a pre-existing gas line of ⅞-inch or ⅜-inch diameter.

Figure 3:
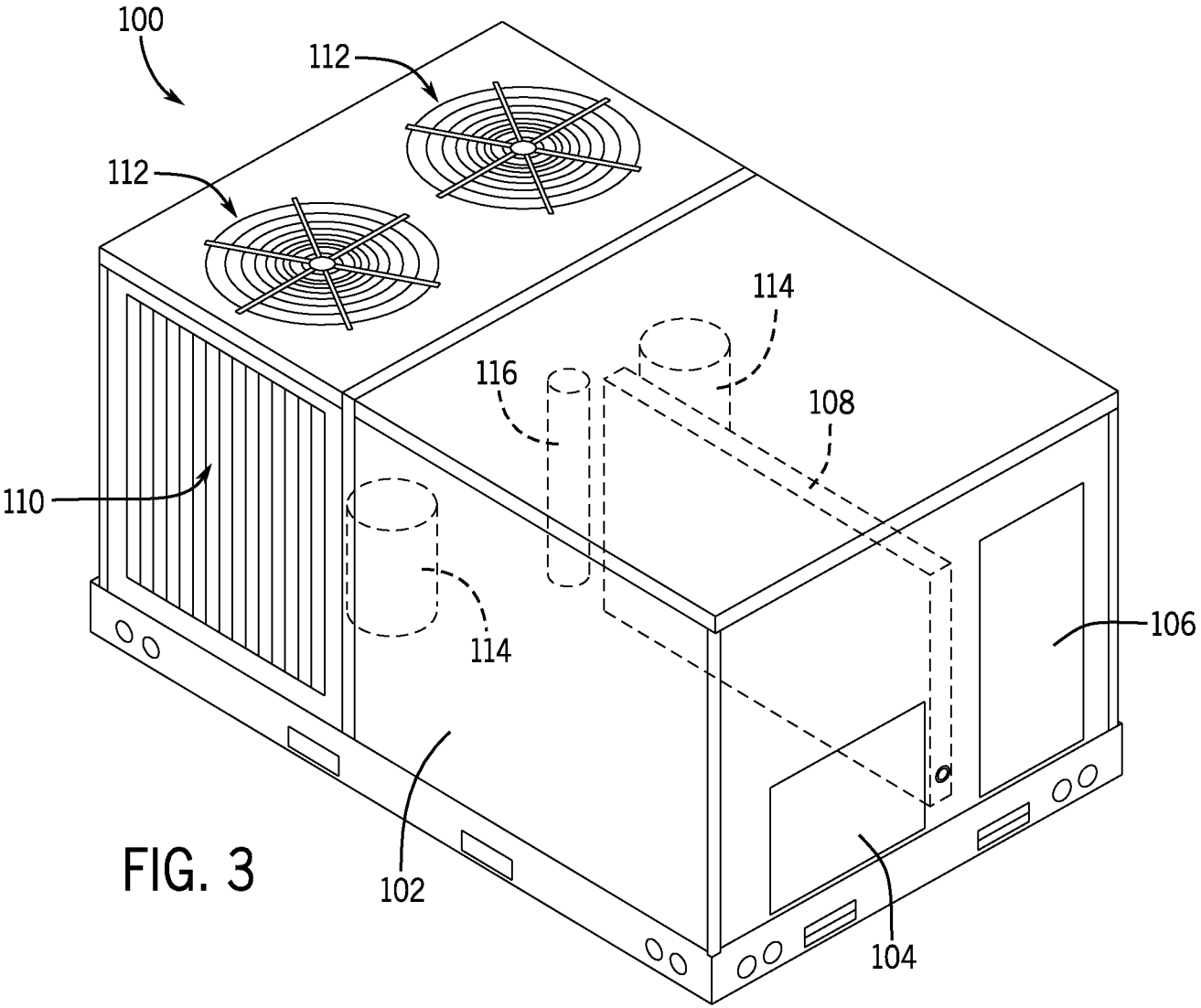
FIG. 3 generally depicts a packaged HVAC system having heat exchangers, a refrigerant expansion device, and other components in a shared cabinet in accordance with one embodiment.

In another embodiment depicted in FIG. 3, a packaged HVAC system 100 includes various components housed in a shared cabinet 102. The packaged system 100 can output conditioned air (e.g., heated or cooled air) from a supply duct opening 104 and draw air into the cabinet 102 via a return duct opening 106. Ductwork can be connected between a structure and the openings 104 and 106 to circulate air between the packaged system 100 and the structure.

Heat exchangers 108 and 110 within the cabinet 102 facilitate heat transfer and allow ambient air received through the return duct opening 106 to be treated (e.g., heated or cooled) and supplied to the structure via the supply duct opening 104. The packaged system 100 can include multiple heat exchangers 110, and fan vents 112 facilitate heat transfer and airflow from the cabinet 102 to the surrounding environment. The heat exchanger 108 is an evaporator coil and the heat exchanger 110 is a condenser coil in at least some instances. Like described above with respect to the split system 10, fluid refrigerant is circulated through and between the heat exchangers 108 and 110 to cause the refrigerant to cycle between the liquid and gas phases and transfer heat with ambient air.

It will be appreciated that other components are also installed within the cabinet 102, such as a blower, compressors 114, and tubing for routing the refrigerant between the compressors 114 and the heat exchangers 108 and 110. The blower generates airflow through the heat exchanger 108, which can condition the air via heat transfer, such as described above. Although two compressors 114 are depicted in FIG. 3, the packaged system 100 can include any suitable number of compressors 114 in other instances. Similarly, the packaged system 100 can include a single blower or multiple blowers to generate airflow through the heat exchanger 108. The cabinet 102 can also include any suitable number of access panels to facilitate access to internal components within the cabinet 102.

Still further, a metering device 116 is shown installed within the cabinet 102 in FIG. 3. The metering device 116 restricts flow of refrigerant to the heat exchanger 108, providing a pressure drop in refrigerant passing through the metering device 116. While the metering device 116 may be provided in any suitable form, in some embodiments the metering device 116 is a fixed orifice expansion device.

Figure 4:
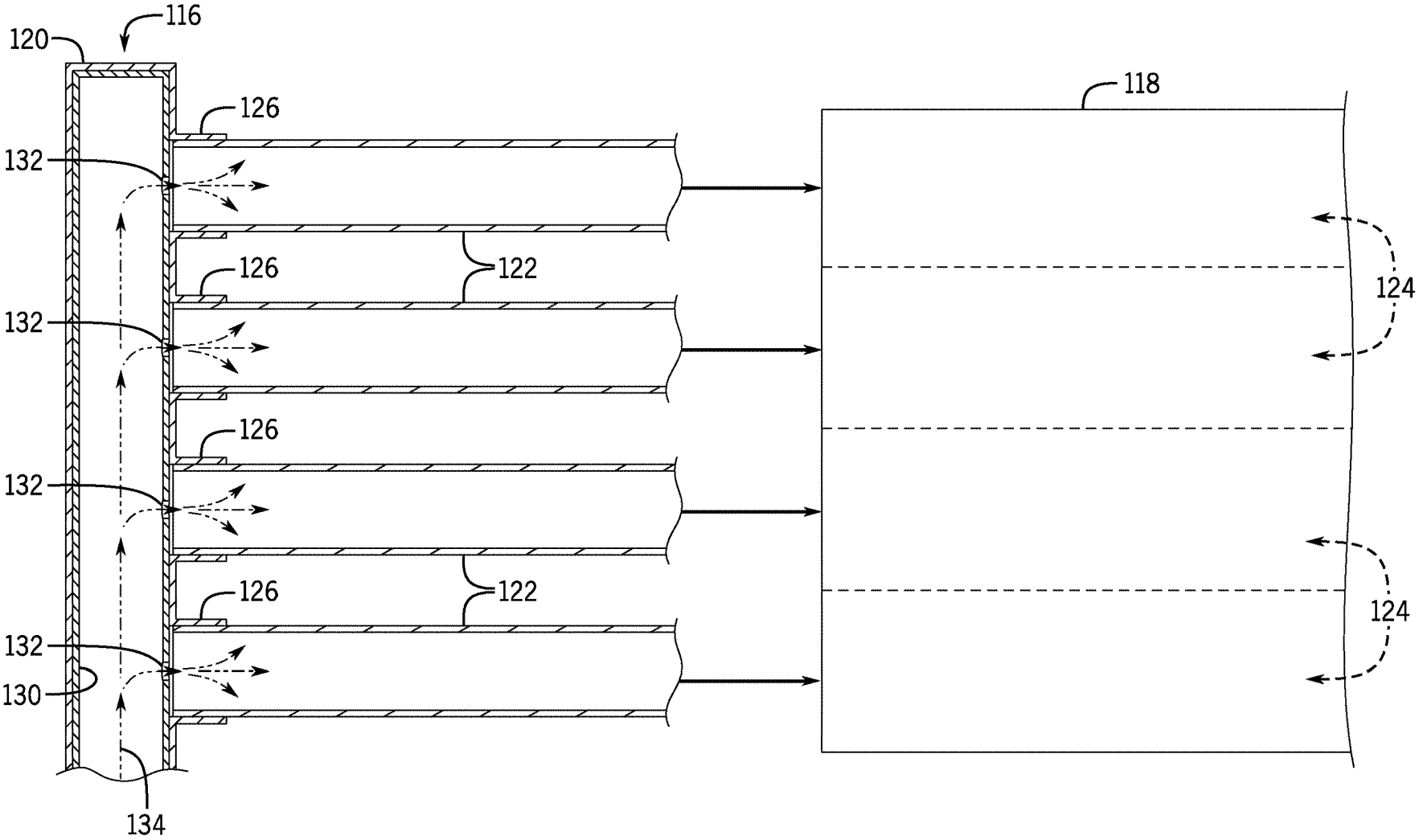
FIG. 4 generally depicts the expansion device of FIG. 3 as a fixed orifice expansion device, having a fixed orifice distributor (or flow restrictor) installed in a manifold, coupled to provide refrigerant to an evaporator coil through refrigerant distribution tubes in accordance with one embodiment.

An example of the metering device 116 in the form of a fixed orifice expansion device is illustrated in FIG. 4. As presently shown, the metering device 116 (which may also be referred to as an expansion device 116) includes a manifold 120 and fixed orifice distributor 130. More specifically, the depicted manifold 120 is an evaporator inlet manifold and the fixed orifice distributor 130 is an insert received within the manifold 120. Refrigerant distribution tubes 122 (e.g., evaporator inlet tubes) couple the manifold 120 to an evaporator coil 118, which may be used as a heat exchanger 36, 42, or 108 in some embodiments.

In at least some instances, the evaporator coil 118 includes multiple refrigerant circuits 124 that are independent of one another in the evaporator coil 118 and that each receive refrigerant from the expansion device 116 through at least one refrigerant distribution tube 122. In FIG. 4, each refrigerant distribution tube 122 is connected to provide refrigerant from the manifold 120 to a different refrigerant circuit 124 of the evaporator coil 118. In other instances, each refrigerant circuit 124 could receive refrigerant from multiple refrigerant distribution tubes 122. And while four refrigerant distribution tubes 122 and four refrigerant circuits 124 are depicted in FIG. 4, other numbers of refrigerant distribution tubes 122 and refrigerant circuits 124 may be used in additional embodiments.

The refrigerant distribution tubes 122 can be connected to the expansion device 116 in any suitable manner. As shown in FIG. 4, the refrigerant distribution tubes 122 are received in necks or collars 126 of the manifold 120. In some instances, the manifold 120 is cast with these collars 126 or is formed through a tee-drilling process to extrude the collars 126 from the main body of the manifold 120 to create outlets for receiving the refrigerant distribution tubes 122. The manifold 120 and refrigerant distribution tubes 122 can be formed of copper or any other suitable materials, and the tubes 122 are brazed to the manifold 120 in at least some embodiments.

The fixed orifice distributor 130 includes fixed orifices 132 in a shared body. The orifices 132 restrict flow of refrigerant (generally referred to by reference numeral 134 in FIG. 4) from the manifold 120 into the refrigerant distribution tubes 124. More specifically, as depicted in FIG. 4, each orifice 132 is aligned with a different refrigerant distribution tube 124 to restrict refrigerant flow from the manifold 120 into the aligned refrigerant distribution tube 124 through that orifice 132. In operation, pressurized refrigerant may flow into the manifold 120, such as into the bottom of the manifold 120, and then exit the manifold 120 through the orifices 132.

Figure 5:
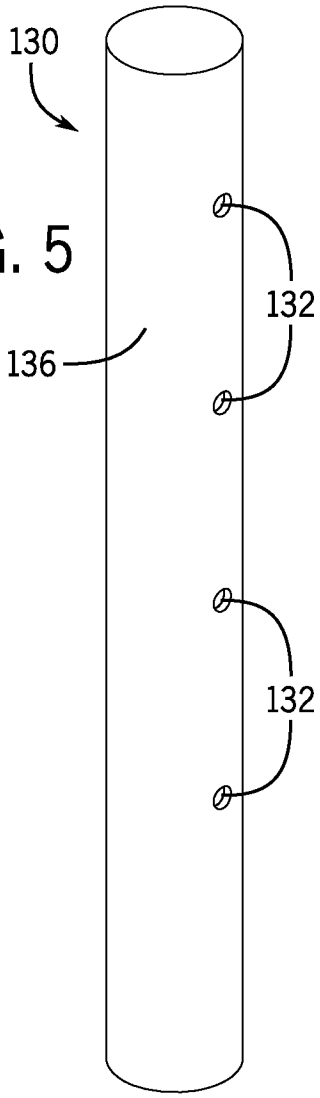
FIG. 5 is a perspective view of the flow restrictor of FIG. 4 and shows the flow restrictor as having round orifices in a cylindrical tube body in accordance with one embodiment.

The fixed orifice distributor 130, which may also be referred to as a flow restrictor 130, can have any suitable shape and configuration. By way of example, the flow restrictor 130 can include a round tube body 136 having the orifices 132, such as shown in FIG. 5. In other instances, a half-tube body, a curved plate body, or some other body with orifices 132 could be used to restrict refrigerant flow from the manifold 120 to the evaporator coil 118 through the orifices 132. In some embodiments, the fixed orifices 132 are formed through pre-stamping, electrical discharge machining, or any other appropriate manufacturing techniques.

Figure 7:
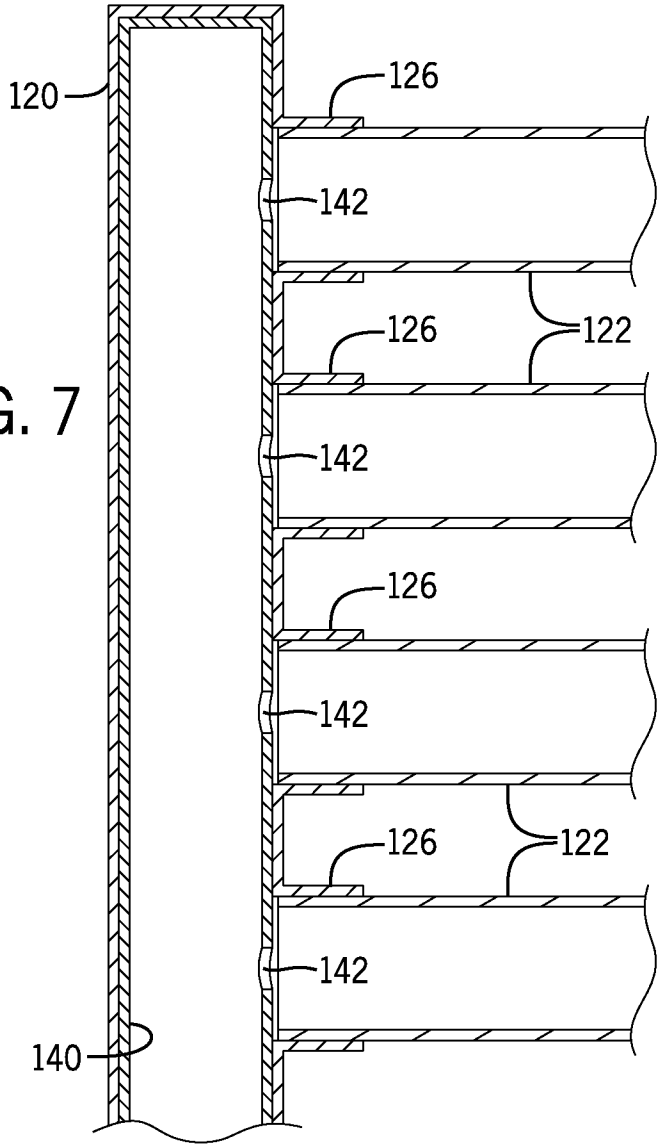
FIG. 7 is a cross-section depicting the flow restrictor of FIG. 6 installed in the manifold of FIG. 4 in accordance with one embodiment.

The manifold 120 can receive various flow restrictors with orifices of different shapes and sizes. In FIGS. 4 and 5, for instance, the flow restrictor 130 within the manifold 120 includes round orifices 132 (e.g., having circular cross-sections) for limiting refrigerant flow out of the manifold 120 into refrigerant distribution tubes 122. In another embodiment depicted in FIG. 6, a flow restrictor 140 includes round orifices 142 in a tube body 144. The flow restrictor 140 is like flow restrictor 130, but the orifices 142 of flow restrictor 140 are larger than the orifices 132 of the flow restrictor 130. The flow restrictor 140 may be received within the manifold 120, as shown in FIG. 7, and used to restrict refrigerant flow out of the manifold 120 through the orifices 142, as described above.

The different sizes of the orifices 132 and 142 will cause different amounts of pressure drop for refrigerant passing through the orifices. The size of an orifice in a flow restrictor is inversely related to the amount of pressure drop of refrigerant passing through that orifice. As such, using the flow restrictor 130 with the smaller orifices 132 will provide a larger pressure drop for refrigerant passing through the orifices than would using the flow restrictor 140 with the larger orifices 142.

Figure 8:
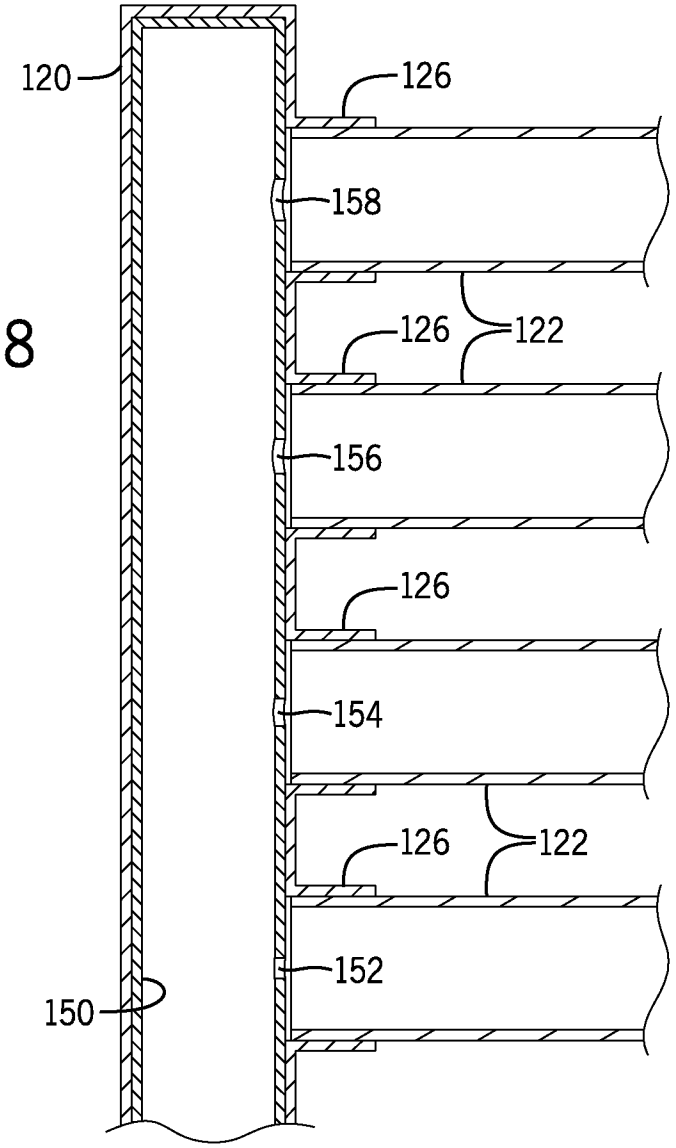
FIG. 8 is a cross-section of a flow restrictor installed in the manifold of FIG. 4, with the flow restrictor having fixed orifices of differing size, in accordance with one embodiment.

As shown in FIGS. 4 and 5, each of the orifices 132 are identically sized. Similarly, each of the orifices 142 are depicted as identically sized in FIGS. 6 and 7. But in some instances a flow restrictor can have orifices of different sizes formed in a shared body. In FIG. 8, for instance, a flow restrictor 150 includes orifices 152, 154, 156, and 158 of increasing size in a shared tube body inserted into the manifold 120. Because of their different sizes, the pressure drop provided by each orifice may differ from that provided by another orifice. This characteristic may be used to individually optimize pressure drop of refrigerant flowing into each of the refrigerant circuits 124 of the evaporator coil 118, allowing selection of the size and shape of each orifice of the expansion device 116 to provide a desired pressure drop for refrigerant to each refrigerant circuit 124 during operation. In at least some cases, the orifice configuration for restricting flow to each circuit 124 of the expansion device 116 is chosen based on the design of that circuit 124, with different orifices chosen for differing circuits 124. The expansion device 116 is a configurable system in that different flow restrictors and different orifice sizes may be used with the manifold 120.

Figure 6:
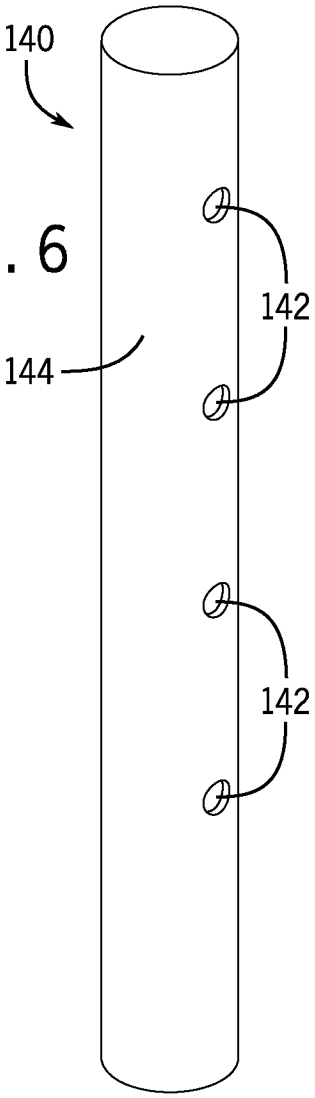
FIG. 6 is a perspective view of a flow restrictor like that of FIG. 5 but with larger round orifices in accordance with one embodiment.
Figure 10:
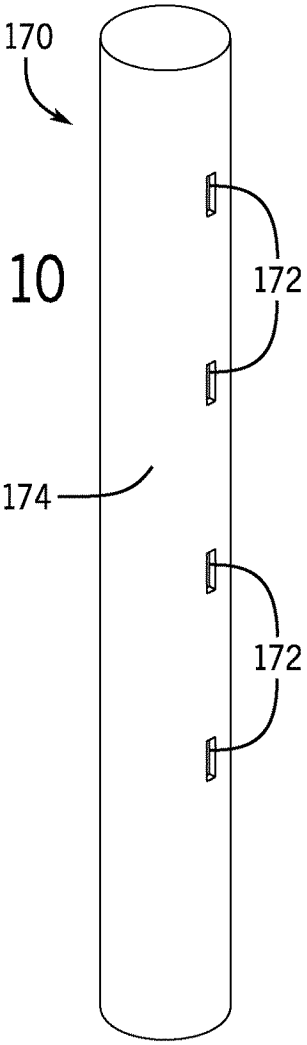
Figure 9:
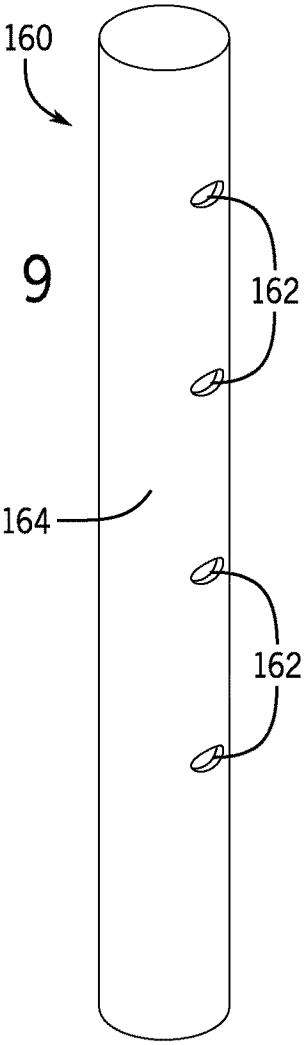

While the flow restrictors of FIGS. 5 and 6 are shown with round orifices, the orifices can have other, non-circular shapes and sizes in different embodiments. In FIG. 9, for instance, a flow restrictor 160 includes oval orifices 162 in a shared tube body 164. In another embodiment shown in FIG. 10, a flow restrictor 170 includes rectangular slots 172 in a shared tube body 174.

Figure 11:
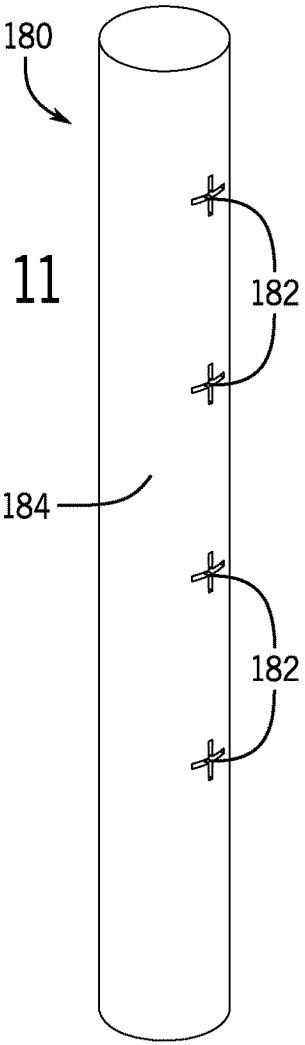
FIGS. 9-11 depict flow restrictors with various non-circular fixed orifices in accordance with some embodiments.

As a further example, a flow restrictor 180 is depicted in FIG. 11 as having orifices 182 in a shared tube body 184. Each orifice 182 includes a pair of intersecting slots. Although the pair of intersecting slots of each orifice 182 are shown perpendicular to one another and in a cross pattern in FIG. 11, in other instances the pair of intersecting slots of each orifice 182 could be provided in some other pattern or angle of intersection. The various fixed orifices described herein can be formed in any suitable manner.

Figure 12:
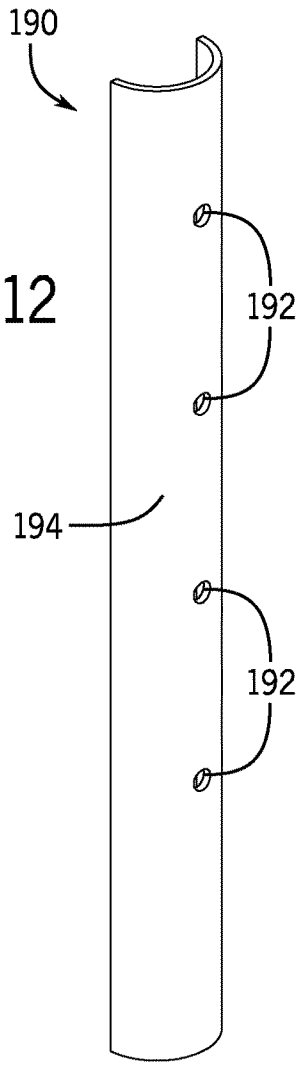
FIG. 12 depicts a flow restrictor as having a half-tube body with fixed orifices in accordance with one embodiment.
Figure 13:
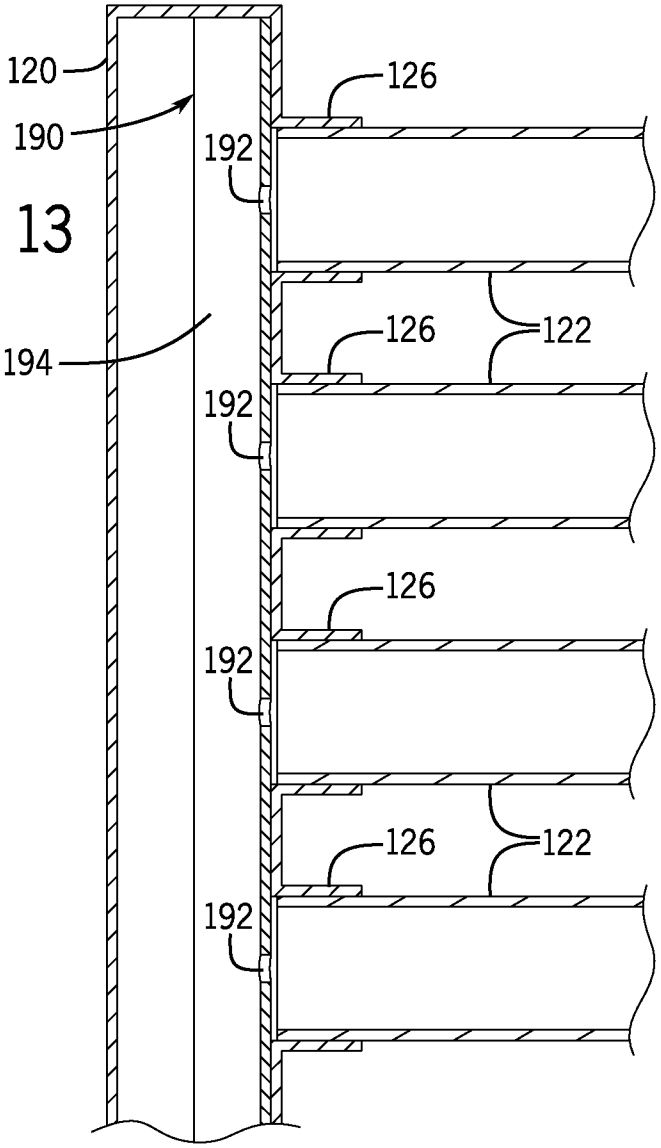
FIG. 13 depicts the flow restrictor of FIG. 12 installed in a manifold in accordance with one embodiment.

Although the flow restrictors of FIGS. 4-11 are shown as having round tube bodies, flow restrictors used with the manifold 120 may have other shapes. In FIGS. 12 and 13, for example, a flow restrictor 190 includes orifices 192 in a shared body 194 that is a curved plate. In some instances, the curved plate of the shared body 194 is a half-tube with a semicircular arc, as shown in FIG. 12. But the curved plate could have a different shape or arc angle in other instances. As with the other embodiments described above, the orifices 192 in the shared body 194 can have any suitable sizes or shapes, and the orifices 192 in the shared body 194 may be identical to or differ from one another. Still further, and as discussed below with respect to FIGS. 17-19, the spacings between the orifices and their angular positions within the manifold can also be different.

Figure 14:
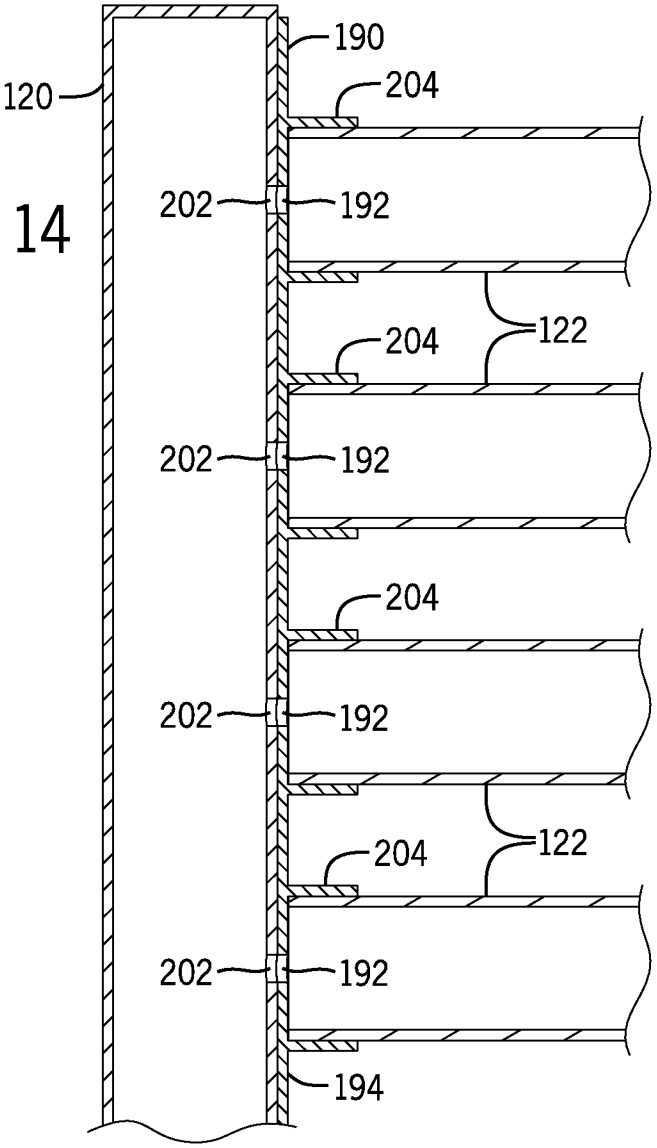
FIG. 14 depicts a flow restrictor with fixed orifices mounted to the exterior of a manifold in accordance with one embodiment.

In still other instances, flow restrictors with orifices may be provided outside of the manifold 120 to restrict flow of refrigerant from the manifold 120 toward the evaporator coil 118 through the orifices. In FIG. 14, for instance, a flow restrictor 190 with orifices 192 in a curved (e.g., half-tube) body 194 is installed outside of the manifold 120, with orifices 192 of the flow restrictor 190 aligned with orifices 202 of the manifold 120 to allow refrigerant flow from the manifold 120 into the refrigerant distribution tubes 122 through the orifices 192 and 202. The orifices 192 and 202 may be identically sized or may differ in size from one another. In this example, collars 126 are omitted from the manifold 120 and the flow restrictor 190 instead includes collars 204 (e.g., of a cast body 194) for receiving the refrigerant distribution tubes 122. The flow restrictor 190 can be connected to the manifold 120 through brazing or in any other suitable manner.

Fixed orifice flow restrictors, such as those described above, can include any suitable positioning features to facilitate alignment and installation of the flow restrictors at (e.g., within or on) an evaporator inlet manifold. The positioning features can provide one or both of angular alignment or longitudinal alignment of the flow restrictor and its orifices with respect to the outlets of the evaporator inlet manifold. Examples of positioning features that could be used include keys, slots, holes, guides, other protrusions or indents, or combinations of these or other positioning features. Each positioning feature could be provided on the evaporator inlet manifold or on the flow restrictor in accordance with the present techniques.

Figure 16:
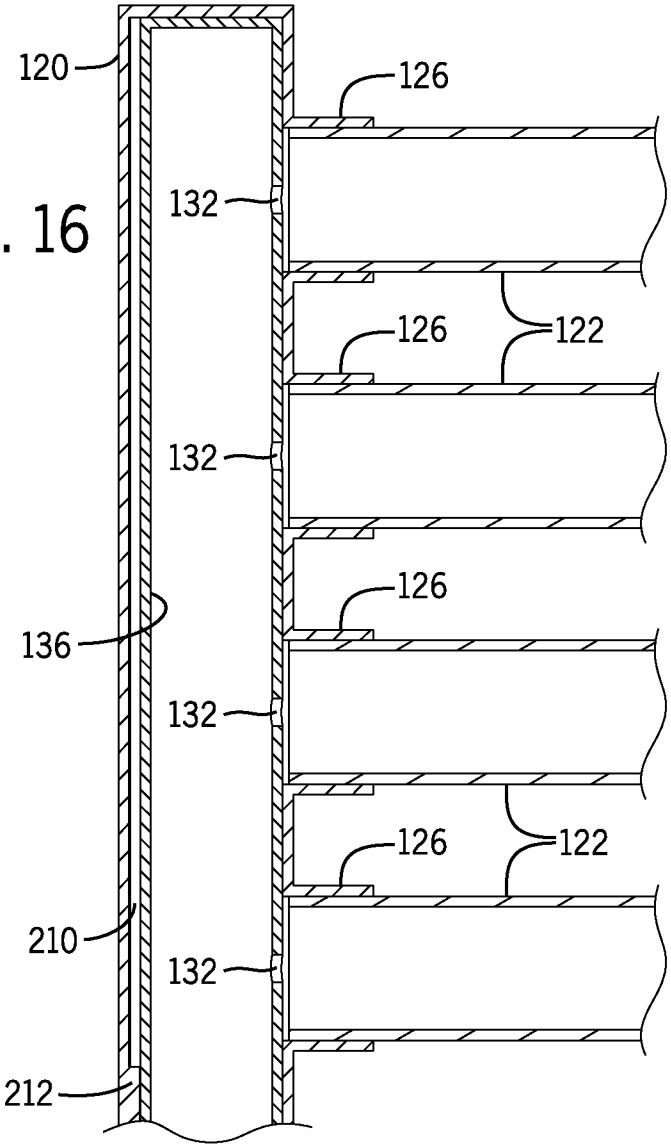
FIG. 16 shows the flow restrictor of FIG. 15 installed in a manifold, with a key of the manifold received in the keyway of the flow restrictor, in accordance with one embodiment.
Figure 15:
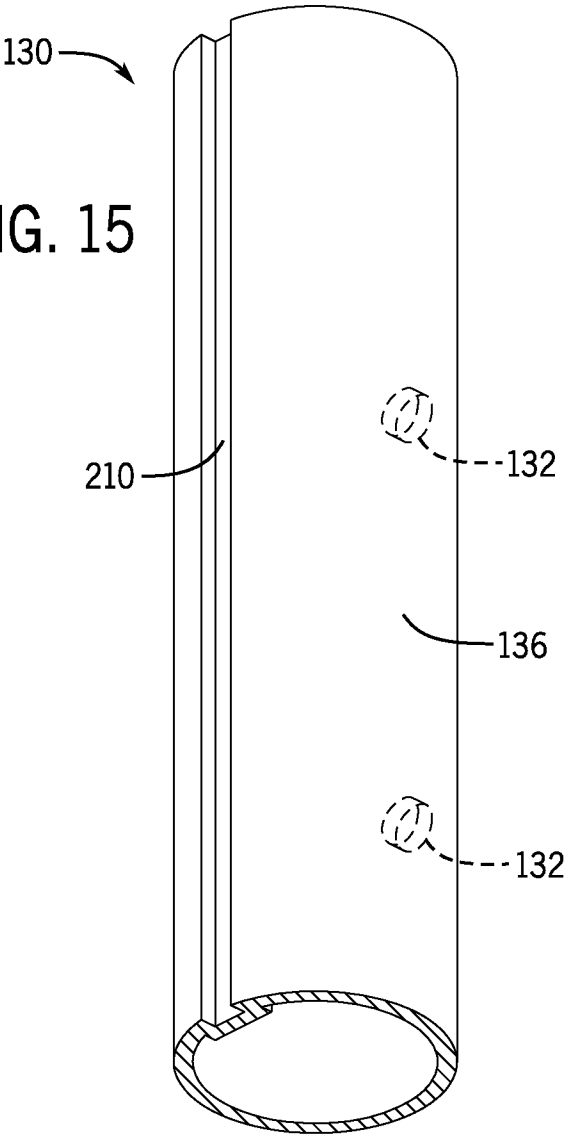
FIG. 15 shows a portion of the flow restrictor of FIGS. 4 and 5 as having a keyway to facilitate alignment and installation in a manifold in accordance with one embodiment.

By way of example, a portion of the flow restrictor 130 is shown in FIG. 15 as having a keyway 210. For installation of the flow restrictor 130 in the manifold 120, the flow restrictor 130 may be rotated with respect to the manifold 120 to align the keyway 210 with a key 212 (FIG. 16) of the manifold 120. The flow restrictor 130 may then be inserted into the manifold 120 such that the key 212 is received in the keyway 210 to ensure angular alignment of the orifices 132 with the refrigerant distribution tubes 122. With the key 212 received in the keyway 210, the flow restrictor 130 may be moved further into the manifold 120 to align longitudinally the orifices 132 with the tubes 122, such as in the position shown in FIG. 16. The key 212 may be formed integrally with the manifold 120 or may be installed in some manner. The locations of the keyway 210 and the key 212 may be reversed in other instances, with the manifold 120 including the keyway 210 and the flow restrictor 130 having the key 212. In FIG. 16, the upper end of the manifold 120 serves as a depth stop, with the orifices 132 longitudinally aligned with the tubes 122 when the end of the body 136 of the flow restrictor 130 abuts the upper end of the manifold 120. But any other suitable positioning features could be used to provide alignment (angular or longitudinal) of the fixed orifices of a flow restrictor with the tubes 122. Once installed, the flow restrictor 130 (or another flow restrictor) can be secured to the manifold 120 and held stationary in any suitable manner.

Figure 19:
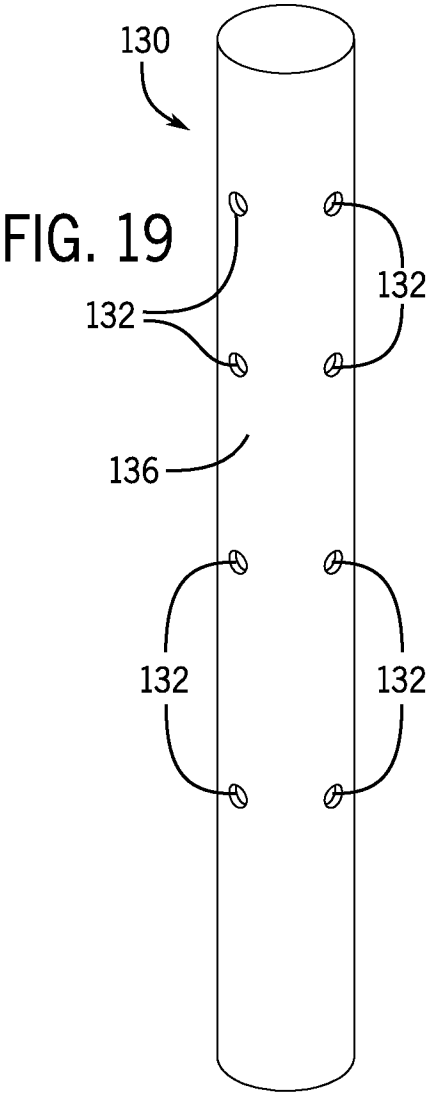
FIG. 19 is a perspective view of a flow restrictor like that of FIG. 17 but with additional orifices in accordance with one embodiment.
Figure 18:
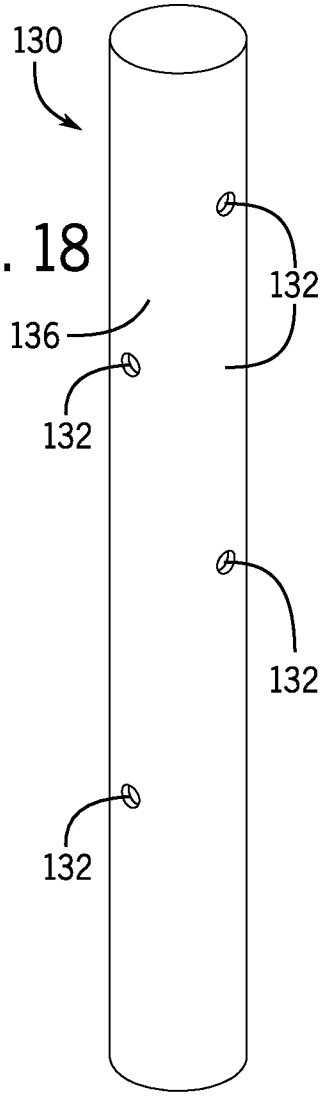
FIG. 18 is a perspective view of a flow restrictor like that of FIG. 17 but with the orifices at multiple angular positions about the flow restrictor in accordance with one embodiment.
Figure 17:
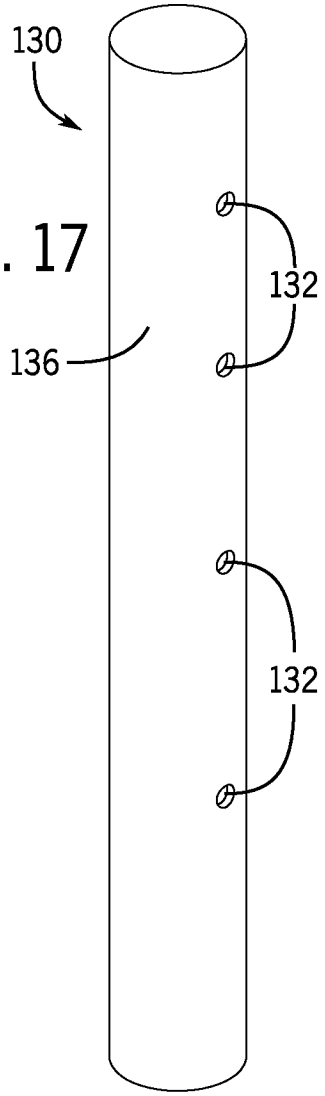
FIG. 17 is a perspective view of a flow restrictor like that of FIG. 5 but with the orifices longitudinally spaced with different distances between the orifices in accordance with one embodiment.

Finally, as noted above, the spacings between the flow restrictor orifices and their angular positions within the manifold can be different in some embodiments. For instance, a flow restrictor 130 is shown in FIG. 17 as having orifices 132 spaced at different longitudinal distances in the tube body 136, with the upper two orifices 132 closer together than the middle two orifices 132, which are themselves closer together than the lower two orifices 132. In FIG. 18, a flow restrictor 130 is depicted as having orifices 132 at multiple angular positions about the circumference of the tube body 136. More specifically, two of the orifices 132 are shown angularly offset from the other two orifices 132 by ninety degrees in FIG. 18. But it will be appreciated that amount of angular offset may vary between or within embodiments. In FIG. 19, a flow restrictor 130 also includes orifices 132 at multiple angular positions in the tube body 136. In this depicted example, the orifices 132 generally run in two parallel columns along the length of the tube body 136, with the columns angularly offset by ninety degrees. But the columns could be angularly offset by one hundred eighty degrees or by any other suitable amount in other embodiments. And while each orifice 132 is longitudinally aligned with another orifice 132 of the opposite column in FIG. 19 (i.e., for each orifice 132 at a longitudinal position along the tube body 136, there is another orifice 132 that is at that same longitudinal position), in other instances each orifice 132 is longitudinally offset from the other orifices 132.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method comprising:

providing a flow restrictor having a plurality of fixed orifices in a shared body; and installing the flow restrictor at an evaporator inlet manifold such that the plurality of fixed orifices are positioned to restrict flow of refrigerant from the evaporator inlet manifold to an evaporator coil, wherein the plurality of fixed orifices includes a first fixed orifice and a second fixed orifice, the first fixed orifice is positioned to restrict flow of refrigerant from the evaporator inlet manifold to the evaporator coil through the first fixed orifice and a first inlet of the evaporator coil, and the second fixed orifice is positioned to restrict flow of refrigerant from the evaporator inlet manifold to the evaporator coil through the second fixed orifice and a second inlet of the evaporator coil, wherein installing the flow restrictor at the evaporator inlet manifold includes inserting the flow restrictor into the evaporator inlet manifold, wherein inserting the flow restrictor into the evaporator inlet manifold includes aligning the first fixed orifice with a first refrigerant distribution tube in fluid communication with the evaporator coil and aligning the second fixed orifice with a second refrigerant distribution tube in fluid communication with the evaporator coil, and wherein inserting the flow restrictor into the evaporator inlet manifold includes engaging an alignment guide to provide angular alignment of the first fixed orifice with the first refrigerant distribution tube and angular alignment of the second fixed orifice with the second refrigerant distribution tube.

2. The method of claim 1, wherein providing the flow restrictor having the plurality of fixed orifices in the shared body includes selecting the flow restrictor to optimize pressure drop of refrigerant passing from the evaporator inlet manifold to the evaporator coil through the flow restrictor.

* * * * *